US011805926B2

(12) United States Patent
Pfeifer

(10) Patent No.: US 11,805,926 B2
(45) Date of Patent: Nov. 7, 2023

(54) CORRUGATED SHELVING DISPLAY WITH TWO-PIECE SHELVES

(71) Applicant: Menasha Corporation, Neenah, WI (US)

(72) Inventor: Mike Pfeifer, Hartford, WI (US)

(73) Assignee: Menasha Corporation, Neenah, WI (US)

( * ) Notice: Subject to any disclaimer, the term of this patent is extended or adjusted under 35 U.S.C. 154(b) by 0 days.

(21) Appl. No.: 18/047,857

(22) Filed: Oct. 19, 2022

(65) Prior Publication Data

US 2023/0129098 A1 Apr. 27, 2023

Related U.S. Application Data

(63) Continuation of application No. 17/386,037, filed on Jul. 27, 2021, now Pat. No. 11,517,129, which is a continuation of application No. 16/942,315, filed on Jul. 29, 2020, now Pat. No. 11,154,145.

(51) Int. Cl.
*A47F 5/11* (2006.01)
*A47B 43/02* (2006.01)

(52) U.S. Cl.
CPC ..... *A47F 5/116* (2013.01); *A47B 43/02* (2013.01)

(58) Field of Classification Search
CPC .. A47F 5/116; A47F 5/11; A47F 5/112; A47F 5/114; A47F 5/118; A47B 43/02; A47B 43/00; A47B 96/021; A47B 55/06; A47B 47/06; A47B 45/00; A47B 2220/0083; A47B 2220/0086
USPC ..... 211/149, 126.16, 135, 72, 73; 248/152, 248/174, 346.4; 229/120.08, 120.32, 229/120.21, 120.28; 220/4.29
See application file for complete search history.

(56) References Cited

U.S. PATENT DOCUMENTS

| | | | | |
|---|---|---|---|---|
| 1,827,008 | A | 10/1931 | Huckel | |
| 1,912,847 | A | 6/1933 | Earl | |
| 1,964,880 | A * | 7/1934 | Katz | A47F 5/116 211/72 |
| 1,992,373 | A | 2/1935 | Johnson | |
| 2,018,707 | A | 10/1935 | Daller | |
| D104,437 | S | 5/1937 | Bulman | |
| 2,150,743 | A | 3/1939 | Mancuso | |
| 2,307,992 | A | 1/1943 | Calhoun et al. | |
| 2,339,656 | A | 1/1944 | Shina | |

(Continued)

FOREIGN PATENT DOCUMENTS

| | | |
|---|---|---|
| CA | 3076091 A1 | 9/2020 |
| CA | 3113145 A1 | 9/2021 |

(Continued)

OTHER PUBLICATIONS

Leblanc, Rick, "Limits on Export Pallets Creating Corrugated Window of Opportunity; Corrugated Pallet Suppliers Experiencing Renewed Interest for Expert, Domestic Markets," http://www.palletenterprise.com/articledatabase/view.asp?articleID-648; 4 pages, Apr. 1, 2002 Apr. 1, 2002.

(Continued)

*Primary Examiner* — Jennifer E. Novosad
(74) *Attorney, Agent, or Firm* — GREENSFELDER, HEMKER & GALE, P.C.; Richard C. Himelhoch

(57) ABSTRACT

A shelving display formed from a blank of material including a plurality of shelves formed from a first shelf component and a second shelf component.

18 Claims, 9 Drawing Sheets

(56) References Cited

U.S. PATENT DOCUMENTS

D146,386 S 2/1947 Shield
D153,188 S 3/1949 Stensgaard
D158,775 S 5/1950 Malkin
D158,776 S 5/1950 Malkin
2,666,531 A 1/1954 Anderson, Jr.
2,706,066 A 4/1955 Wells
2,743,021 A * 4/1956 Glenn ..... A47F 5/112 211/49.1
2,798,685 A 7/1957 Mooney
2,884,179 A 4/1959 Rossum
2,918,178 A 12/1959 Leone
2,944,555 A 7/1960 Peel et al.
2,975,890 A 3/1961 Block
2,997,222 A 8/1961 Sperry
3,000,602 A 9/1961 O'Brien
3,026,015 A 3/1962 Severn
3,026,078 A 3/1962 Simkins
3,058,646 A 10/1962 Guyer
3,161,341 A 12/1964 Farquhar
D204,434 S 4/1966 Kingsford
3,362,610 A * 1/1968 Van Dyke ..... B65D 5/4804 229/122
3,480,196 A 11/1969 De Simas
3,514,031 A 5/1970 Burgess
3,528,559 A 9/1970 Miller
3,690,118 A 9/1972 Rainwater
3,696,990 A 10/1972 Dewhurst
3,730,417 A 5/1973 Lawson
3,857,494 A 12/1974 Giardini
3,879,053 A 4/1975 Chvala
3,886,348 A 5/1975 Jonathan et al.
3,889,867 A 6/1975 Berg
3,944,128 A 3/1976 Hogan
D239,805 S 5/1976 South
4,004,691 A 1/1977 Wihksne
D244,117 S 4/1977 Naylor
4,085,847 A 4/1978 Jacalone
4,099,813 A 7/1978 Olivan
4,171,741 A 10/1979 Fish
4,271,766 A 6/1981 Schmiedeler
4,283,000 A 8/1981 White
4,292,901 A 10/1981 Cox
4,311,100 A * 1/1982 Gardner ..... A47F 5/116 108/165
4,375,874 A 3/1983 Leotta et al.
4,376,558 A 3/1983 Bandar
4,493,424 A 1/1985 Smith
4,503,973 A 3/1985 Andersson
4,506,790 A 3/1985 Muscari
D278,493 S 4/1985 Brescia et al.
4,512,541 A 4/1985 Lietzke
4,570,805 A 2/1986 Smith
4,602,735 A 7/1986 Aaron
4,610,355 A 9/1986 Maurer
4,618,115 A 10/1986 Belokin, Jr.
4,630,740 A 12/1986 Belokin, Jr.
4,646,922 A * 3/1987 Smith ..... A47F 5/116 211/186
4,658,984 A 4/1987 Brunner
4,673,092 A 6/1987 Lamson et al.
4,688,716 A 8/1987 Winterling
D292,659 S 11/1987 Svezia et al.
D293,520 S 1/1988 Ovitz, III
4,722,473 A 2/1988 Sandrini et al.
D294,908 S 3/1988 Childress
4,765,492 A 8/1988 Toward et al.
4,785,944 A * 11/1988 March ..... A47F 5/116 211/72
4,793,664 A 12/1988 Jackson
4,826,265 A 5/1989 Hockenberry
4,836,379 A 6/1989 Shaw
4,850,284 A 7/1989 DeGroot et al.
4,852,756 A 8/1989 Holladay
4,863,024 A 9/1989 Booth
4,871,067 A 10/1989 Valenti
4,877,137 A 10/1989 Govang et al.
4,899,929 A 2/1990 Grollman
4,911,084 A 3/1990 Sato et al.
4,911,311 A 3/1990 Nagai
4,936,470 A 6/1990 Prindle
D321,100 S 10/1991 Dorrell
D321,295 S 11/1991 Nuebler
D321,615 S 11/1991 Lavine et al.
5,067,418 A 11/1991 Carter
5,119,740 A 6/1992 Carter
5,125,520 A 6/1992 Kawasaki
5,141,105 A 8/1992 Maye
5,176,265 A 1/1993 Bennett
D332,883 S 2/1993 Staude
5,183,166 A 2/1993 Belokin, Jr. et al.
5,190,211 A * 3/1993 Stoddard ..... A47F 5/116 229/120.21
5,195,440 A 3/1993 Gottlieb
5,213,220 A * 5/1993 McBride ..... A47B 55/06 211/132.1
5,259,631 A 11/1993 Brande
5,269,219 A 12/1993 Juvik-Woods
5,272,990 A 12/1993 Carter
5,315,936 A 5/1994 Smith
D349,202 S 8/1994 Eliadis et al.
5,335,593 A 8/1994 Stoddard et al.
D351,076 S 10/1994 Eliadis et al.
5,357,875 A 10/1994 Winebarger et al.
5,388,531 A 2/1995 Crews et al.
5,392,902 A * 2/1995 Vlastakis ..... A47F 5/116 108/165
5,413,053 A 5/1995 Vannatta
5,427,019 A 6/1995 Moorman
5,443,168 A 8/1995 Dyment et al.
D362,768 S 10/1995 Lechleiter et al.
5,458,411 A 10/1995 Moss
D363,840 S 11/1995 Weshler
5,465,672 A 11/1995 Boyse et al.
5,465,851 A 11/1995 Smith
5,487,344 A 1/1996 Hutchinson
5,487,345 A 1/1996 Winebarger
D369,035 S 4/1996 Potter
D369,043 S 4/1996 Parker
5,520,120 A 5/1996 Badger
5,528,994 A 6/1996 Iseli
5,540,536 A 7/1996 Hoedl
5,543,205 A 8/1996 Liebel
5,590,606 A 1/1997 Crews et al.
5,603,258 A 2/1997 Besaw
5,622,306 A 4/1997 Grigsby et al.
5,630,518 A 5/1997 Collins
5,669,683 A * 9/1997 Moss ..... A47B 47/06 312/259
5,672,412 A 9/1997 Phares et al.
5,678,492 A * 10/1997 Pinkstone ..... A47B 43/02 108/165
5,685,234 A 11/1997 Grigsby et al.
D388,905 S 1/1998 Wells
5,706,953 A 1/1998 Polvere
5,706,959 A 1/1998 Smith
5,711,423 A 1/1998 Fuller, Jr.
D395,534 S 6/1998 Besaw
5,758,783 A 6/1998 Maglione
5,762,213 A 6/1998 Heneveld, Sr.
5,791,487 A 8/1998 Dixon
5,794,542 A 8/1998 Besaw
5,797,499 A 8/1998 Pinco
D398,461 S 9/1998 Baluk et al.
D398,462 S 9/1998 Baluk et al.
5,809,903 A 9/1998 Young, Jr.
5,816,172 A 10/1998 Carter
5,826,732 A * 10/1998 Ragsdale ..... A47F 5/116 108/165
5,832,841 A 11/1998 Crews et al.
5,881,652 A 3/1999 Besaw
D412,253 S 7/1999 Brozak, Jr.
5,918,744 A 7/1999 Bringard et al.
5,950,914 A 9/1999 Dunton et al.

(56) References Cited

U.S. PATENT DOCUMENTS 5,980,008 A 11/1999 Stoever
5,996,366 A 12/1999 Renard
5,996,510 A 12/1999 Harpman et al.
D419,275 S 1/2000 Carter
D419,744 S 1/2000 Carter
6,012,399 A 1/2000 Carter
6,070,726 A 6/2000 Graham
6,076,475 A 6/2000 Kuhn et al.
D428,738 S 8/2000 Brozak, Jr.
6,098,820 A 8/2000 Smith
6,126,131 A 10/2000 Tietz
6,126,254 A 10/2000 Maglione
6,135,030 A 10/2000 Besaw
D433,782 S 11/2000 Carter
D433,839 S 11/2000 Culbertson
6,145,671 A 11/2000 Riga et al.
6,145,794 A 11/2000 Smith
6,164,215 A 12/2000 Cook et al.
6,189,778 B1 2/2001 Kanter
6,302,283 B1 10/2001 Yeh
D453,057 S 1/2002 Sewell
6,354,229 B1 3/2002 Heidtke
6,357,587 B1 3/2002 Melms, Jr.
6,360,465 B1 3/2002 Simpson
6,378,710 B1 * 4/2002 Grueneberg ..... A47F 5/116 211/72
6,394,003 B1 5/2002 Lacy, III
6,394,290 B1 5/2002 Walsh et al.
D461,334 S 8/2002 Johnson et al.
D464,498 S 10/2002 Riga et al.
6,510,982 B2 1/2003 White et al.
6,585,118 B2 7/2003 Kellogg
6,612,247 B1 9/2003 Pistner et al.
6,612,669 B2 * 9/2003 Grueneberg ..... A47B 43/02 108/165
6,659,295 B1 12/2003 De Land et al.
6,715,623 B2 4/2004 Broerman
6,729,484 B2 5/2004 Sparkowski
6,752,280 B2 6/2004 Dye
6,758,352 B2 7/2004 Gervasi
6,769,368 B2 8/2004 Underbrink et al.
D495,901 S 9/2004 Bosman
6,814,245 B2 11/2004 Leclerc et al.
6,902,074 B2 6/2005 Albrecht
6,905,021 B2 6/2005 Polumbaum et al.
D509,382 S 9/2005 Raile
6,951,300 B2 10/2005 Caille et al.
6,966,447 B2 11/2005 Hiltke et al.
7,007,615 B2 3/2006 Grueneberg
D521,275 S 5/2006 Dusenberry
7,036,196 B2 5/2006 Salatin et al.
7,066,342 B2 6/2006 Baechle et al.
7,066,380 B2 6/2006 Blake
7,089,872 B2 8/2006 Wintermute, II et al.
7,111,735 B2 9/2006 Lowry
7,137,517 B2 11/2006 Lowry et al.
D533,734 S 12/2006 Campbell
7,191,906 B1 3/2007 Pinco
7,234,604 B2 6/2007 Eisele
7,252,200 B1 * 8/2007 Hester ..... A47F 5/116 211/187
D566,989 S 4/2008 Mason
D576,426 S 9/2008 Yuen-Schat et al.
D578,804 S 10/2008 Norman et al.
7,546,926 B2 6/2009 Stolle et al.
7,546,927 B2 6/2009 Lowry et al.
7,571,820 B2 8/2009 Alexander
D603,189 S 11/2009 Raile
7,650,996 B2 1/2010 Mark
7,677,433 B2 * 3/2010 Little ..... B65D 5/526 229/120.31
7,703,665 B2 4/2010 McGowan
7,703,864 B2 * 4/2010 Moser ..... B65D 5/5213 312/261
7,717,265 B2 5/2010 Honkawa et al.
7,726,474 B2 6/2010 Berger et al.
7,828,169 B2 11/2010 Robinson et al.
7,882,966 B2 2/2011 Field et al.
7,905,365 B2 3/2011 Virvo
7,992,716 B2 8/2011 Jackson
8,002,171 B2 8/2011 Ryan et al.
8,141,713 B2 3/2012 Farkas et al.
8,157,112 B2 4/2012 Bojie
8,317,039 B2 11/2012 Norman
8,485,370 B2 * 7/2013 Dewhurst ..... A47F 5/0018 211/149
8,651,297 B2 * 2/2014 Beaty ..... A47F 5/116 211/72
8,857,633 B2 10/2014 Dewhurst
8,985,328 B2 3/2015 Slaats
9,045,250 B2 6/2015 Henderson et al.
9,198,508 B1 12/2015 Kufel
9,211,021 B2 * 12/2015 Smith ..... A47F 5/116
9,428,298 B2 8/2016 Bersamin et al.
9,474,389 B2 10/2016 Pfeifer et al.
9,487,321 B2 11/2016 Luke
9,743,783 B1 8/2017 Bersamin
9,844,282 B2 12/2017 Smith
9,907,414 B2 * 3/2018 Heuer ..... A47B 96/021
9,918,569 B1 * 3/2018 Abel ..... B65D 5/5213
9,919,829 B2 3/2018 Jolley
9,938,040 B2 4/2018 Buscema
9,969,523 B2 5/2018 Ayerst
10,117,529 B2 11/2018 Abel
10,123,635 B2 11/2018 Lilja
10,159,362 B2 12/2018 Smith
10,306,999 B2 6/2019 Smith
10,315,798 B2 6/2019 Pfeifer et al.
10,448,758 B1 10/2019 Abel
10,463,176 B1 * 11/2019 Sells ..... A47F 5/114
10,470,591 B1 * 11/2019 Heiden ..... A47F 5/116
10,524,588 B2 1/2020 Pratsch
10,524,589 B2 1/2020 Donegan
10,531,750 B1 1/2020 Heiden et al.
10,568,422 B2 * 2/2020 Gibbons, Jr. ..... A47F 5/116
10,568,439 B2 * 2/2020 Bersamin ..... A47F 5/116
10,888,180 B2 * 1/2021 Robinson ..... A47F 5/16
10,905,260 B2 * 2/2021 Hara ..... A47F 5/114
10,973,317 B2 4/2021 Gibbons, Jr. et al.
11,019,943 B2 6/2021 Burgert et al.
11,033,120 B2 6/2021 Frost
11,154,145 B1 * 10/2021 Pfeifer ..... A47F 5/116
11,517,129 B2 * 12/2022 Pfeifer ..... A47B 43/02
2002/0189507 A1 12/2002 Benner
2003/0042828 A1 3/2003 Bonin
2003/0042829 A1 3/2003 Bonin
2003/0111383 A1 6/2003 Qiu et al.
2004/0195195 A1 10/2004 Mason
2005/0252872 A1 11/2005 Eisele
2005/0274684 A1 12/2005 Swanson
2006/0006096 A1 1/2006 Funk
2006/0261025 A1 * 11/2006 Heyderman ..... A47F 5/118 211/187
2006/0283775 A1 12/2006 Mark
2007/0193479 A1 8/2007 Slaats
2007/0272639 A1 11/2007 Alexander
2008/0169339 A1 7/2008 Moser
2008/0169340 A1 7/2008 Sheffer
2008/0173602 A1 * 7/2008 Field ..... A47F 5/116 211/149
2008/0265726 A1 10/2008 Sheffer
2009/0107940 A1 4/2009 Norman et al.
2009/0127150 A1 5/2009 Meers
2010/0006529 A1 1/2010 Groff et al.
2010/0025344 A1 * 2/2010 Virvo ..... A47F 5/116 211/59.2
2010/0133215 A1 6/2010 Norman
2011/0000955 A1 1/2011 Manteufel et al.
2011/0049072 A1 3/2011 Dewhurst
2011/0266177 A1 11/2011 Lowry et al.
2012/0074037 A1 3/2012 Orischak et al.
2012/0305512 A1 12/2012 L'Hotel
2013/0097903 A1 4/2013 Gerstner

(56) References Cited

U.S. PATENT DOCUMENTS

| | | | | |
|---|---|---|---|---|
| 2013/0213915 | A1 | 8/2013 | Pfeifer et al. | |
| 2013/0264923 | A1* | 10/2013 | Brady | A47B 43/003 312/258 |
| 2013/0277324 | A1 | 10/2013 | Dewhurst | |
| 2014/0217047 | A1 | 8/2014 | Frost | |
| 2015/0041420 | A1 | 2/2015 | Zelek et al. | |
| 2015/0136720 | A1 | 5/2015 | Miller | |
| 2016/0066711 | A1 | 3/2016 | Mestres Armengol et al. | |
| 2016/0198870 | A1* | 7/2016 | Volz | A47F 5/116 211/135 |
| 2017/0079449 | A1 | 3/2017 | Smith | |
| 2017/0086604 | A1* | 3/2017 | Goldsmith | A47F 5/114 |
| 2017/0295927 | A1 | 10/2017 | Gibbons, Jr. et al. | |
| 2018/0042405 | A1 | 2/2018 | Lilja | |
| 2018/0070747 | A1 | 3/2018 | Smith | |
| 2018/0092461 | A1 | 4/2018 | Brady et al. | |
| 2018/0130382 | A1 | 5/2018 | Tinch et al. | |
| 2018/0146803 | A1 | 5/2018 | Urban | |
| 2018/0160825 | A1 | 6/2018 | Abel | |
| 2018/0289178 | A1 | 10/2018 | McMillan-Sweat et al. | |
| 2019/0008290 | A1 | 1/2019 | Ertl | |
| 2019/0014927 | A1* | 1/2019 | Nixon | A47B 55/06 |
| 2019/0069694 | A1 | 3/2019 | Smith | |
| 2019/0150611 | A1 | 5/2019 | Burnett | |
| 2019/0380513 | A1 | 12/2019 | Frost | |
| 2020/0037787 | A1 | 2/2020 | Pratsch | |
| 2020/0077816 | A1* | 3/2020 | Doane | A47B 43/02 |
| 2020/0113355 | A1 | 4/2020 | Hara et al. | |
| 2020/0221866 | A1* | 7/2020 | Dell | A47F 7/145 |
| 2020/0260866 | A1 | 8/2020 | Gibbons, Jr. et al. | |
| 2020/0288881 | A1 | 9/2020 | Burgert et al. | |
| 2020/0297132 | A1 | 9/2020 | Nguyen et al. | |
| 2020/0375375 | A1 | 12/2020 | Robinson | |
| 2021/0015273 | A1* | 1/2021 | Nelson | A47F 5/16 |
| 2021/0244178 | A1 | 8/2021 | Gibbons, Jr. et al. | |
| 2021/0298493 | A1 | 9/2021 | Rose | |
| 2021/0307542 | A1 | 10/2021 | Burgert et al. | |

FOREIGN PATENT DOCUMENTS

| | | | |
|---|---|---|---|
| CA | 3124854 | C | 9/2022 |
| DE | 102006043829 | A1 | 3/2008 |
| DE | 102011116238 | A1 | 4/2013 |
| EP | 0629557 | A1 | 12/1994 |
| FR | 2984705 | A3 | 6/2013 |
| JP | 6278746 | A | 10/1994 |
| WO | 2008127499 | A1 | 10/2008 |

OTHER PUBLICATIONS

"Solid Wood Packing Materials to Argentina;" http://www.corrugatedprices.com/pallets/swang.html; 2 pages; Feb. 5, 2002.

U.S. Appl. No. 12/621,221 at the U.S. Patent and Trademark Office, filed Feb. 5, 2002.

* cited by examiner

CORRUGATED SHELVING DISPLAY WITH TWO-PIECE SHELVES

CROSS-REFERENCE TO RELATED APPLICATIONS

The present application is a continuation of U.S. patent application Ser. No. 17/386,037, filed Jul. 27, 2021, which is a continuation of U.S. patent application Ser. No. 16/942,315, filed Jul. 29, 2020, now U.S. Pat. No. 11,154,145, the contents of which are incorporated herein by reference and made a part hereof.

FEDERALLY SPONSORED RESEARCH OR DEVELOPMENT

N/A

FIELD OF THE INVENTION

The present invention generally relates to a shelving display formed from a blank of material having a plurality of shelves each cooperatively formed by a first panel and a second panel.

BACKGROUND OF THE INVENTION

A variety of systems are used to display merchandise. Some of these systems can be costly and difficult to manufacture, as well as ship or set up on site.

The present invention provides an embodiment of a shelving display that overcomes the problems of prior displays.

SUMMARY OF THE INVENTION

A shelving display is disclosed having a back wall having a generally U-shaped portion removed defining two spaced-apart, deflectable tabs, a stop panel therebetween, and a pair of slots. One of each slot is associated respectively with one of each of the two deflectable tabs and extends through the back wall. A first side wall extends from a first side of the back wall toward a front portion of the display. A second side wall extends from a second side of the back wall toward a front portion of the display. A first shelf formed from a first shelf component and a second shelf component extends between the first side wall and the second side wall. The first shelf component has a first shelf panel extending between the first side wall and the second side wall approximately midway from the back wall to the front portion of the display. The first shelf panel is integrally connected to a strip of material glued to an interior surface of one of the first and second side walls. A leading edge of the first shelf panel has a pair of spaced-apart flanges, one of each of the flanges being positioned respectively in one of each of the pair of slots. A portion of each of the pair of flanges extends outward of the back wall. The second shelf component has a second shelf panel extending between the first side wall and the second side wall proximate the front portion of the display.

Also disclosed is a multiple shelve shelving display having a back wall having a generally U-shaped portion removed defining two spaced-apart, deflectable tabs, a stop panel therebetween, and a pair of slots. One of each slot is associated with one of each of the two deflectable tabs and extends through the back wall. A first side wall extends from a first side of the back wall toward a front portion of the display. A second side wall extends from a second side of the back wall toward a front portion of the display. A plurality of shelves extend between the first side wall and the second side wall and are vertically spaced from one another. Each shelf of the plurality of shelves includes a first shelf component and a second shelf component extending between the first side wall and the second side wall. The first shelf component has a first shelf panel extending between the first side wall and the second side wall approximately midway from the back wall to the front portion of the display. The first shelf panel is integrally connected to a strip of material glued to an interior surface of one of the first and second side walls. A leading edge of the first shelf panel has a pair of spaced-apart flanges, one of each of the flanges being positioned respectively in one of each of the pair of slots. A portion of each of the pair of flanges extends outward of the back wall. The second shelf component has a second shelf panel extending between the first side wall and the second side wall proximate the front portion of the display.

Also disclosed is a blank of corrugated material for creating a shelving display having two-part shelves. The blank has a back wall panel having a plurality of U-shaped cutouts spaced from one another and each of the plurality of U-shaped cutouts define two spaced-apart, deflectable tabs, a stop panel therebetween, and a pair of slots. One of each slot is associated with one of each of the two deflectable tabs and extends through the back wall panel. The back wall panel is integrally connected on a first side to a first side of a positioning panel. The positioning panel is integrally connected on a second side to a first side of a first shelf panel. The back wall panel is integrally connected on a second side to a first side of a first side wall panel, the first side wall panel integrally connected on a second side to a first side of a second shelf panel. The second shelf panel is integrally connected on a second side to a first side of a second side wall panel. The first shelf panel includes a plurality of first shelf components and the second shelf panel includes a plurality of second shelf components. Each of the plurality of second shelf components of the second shelf panel cooperate with a corresponding one of the plurality of first shelf components of the first shelf panel to form a plurality of shelves for the display.

Other features and advantages of the invention will be apparent from the following specification taken in conjunction with the following figures.

BRIEF DESCRIPTION OF THE FIGURES

To understand the present invention, it will now be described by way of example, with reference to the accompanying figures in which.

DETAILED DESCRIPTION OF THE INVENTION

While this invention is susceptible of embodiments in many different forms, there is shown in the figures and will herein be described in detail preferred embodiments of the invention with the understanding that the present disclosure is to be considered as an exemplification of the principles of the invention and is not intended to limit the broad aspect of the invention to the embodiments illustrated.

Figure 6:
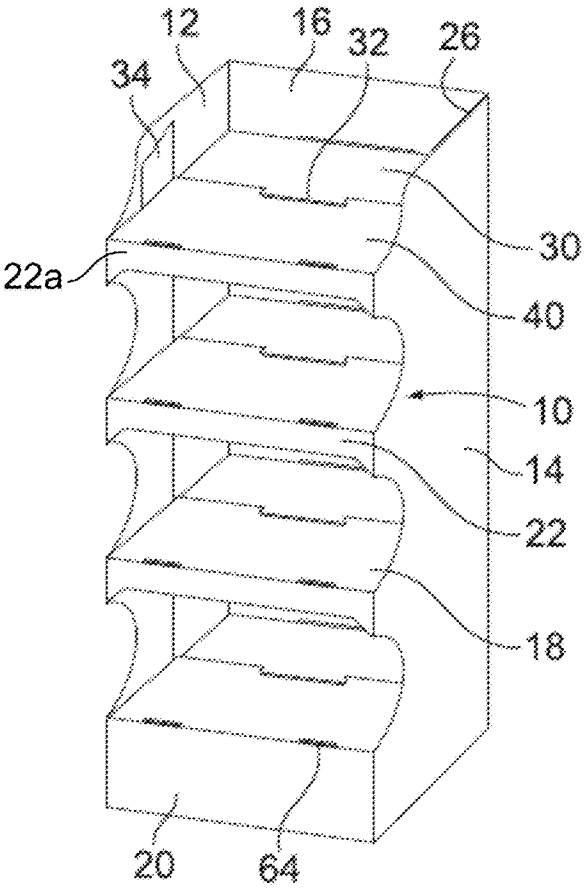
FIG. 6 PRIOR ART
FIG. 6 is a front perspective view of a prior art shelving display having two-part shelves.
Figure 5:
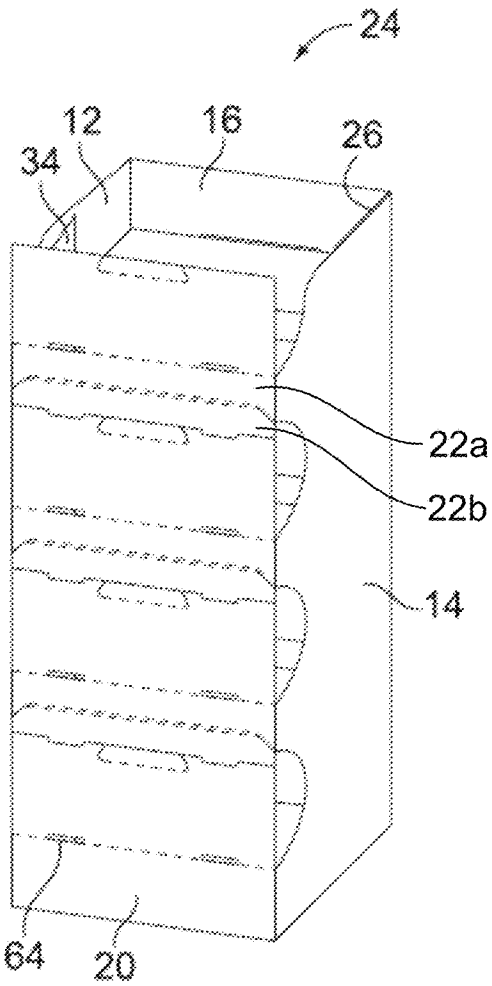
FIG. 5 PRIOR ART
FIG. 5 is a perspective view of the prior art blank of FIG. 1 further folded from the position in FIG. 4.
Figure 4:
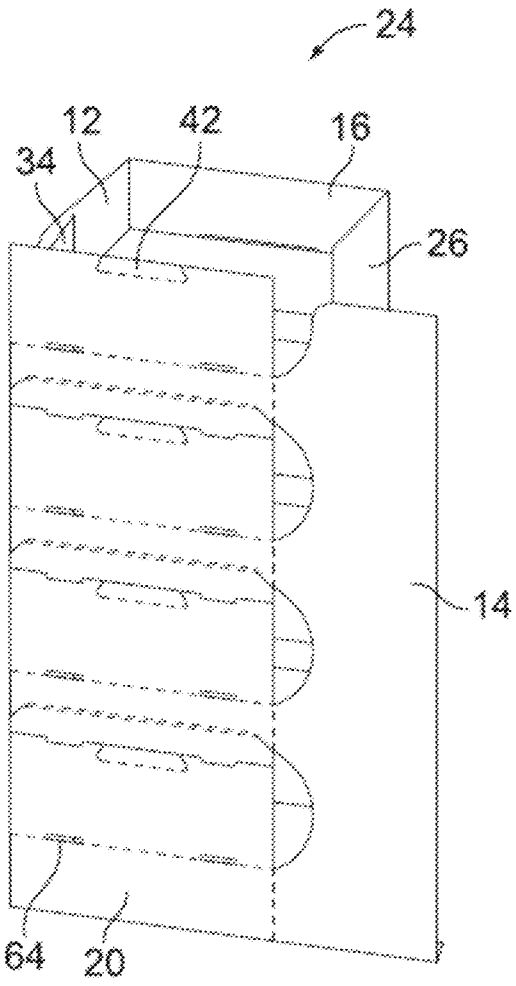
FIG. 4 PRIOR ART
FIG. 4 is a perspective view of the prior art blank of FIG. 1 further folded from the position in FIG. 3.

A shelving display 10 is shown set-up in FIG. 6. The shelving display 10 includes a first side wall 12 and a second side wall 14. The first and second side walls 12, 14 extend from a back wall 16.

A plurality of shelves 18 are supported between the first side wall 12 and the second side wall 14. The bottom shelf of the plurality of shelves 18 includes a front panel 20 that extends downward to the floor to form a base of the shelving display 10 along with lower portions of the first side wall 12, the second side wall 14, and the back wall 16. The embodiment shown in FIG. 6 includes four shelves 18. However, a shelving display made in accordance with the inventions of the present application can include more or fewer shelves. As discussed below, each of the plurality of shelves 18 is formed from two parts—a first shelf component is provided from a first shelf panel 28, and a second shelf component is provided from a second shelf panel 38.

Figure 1:
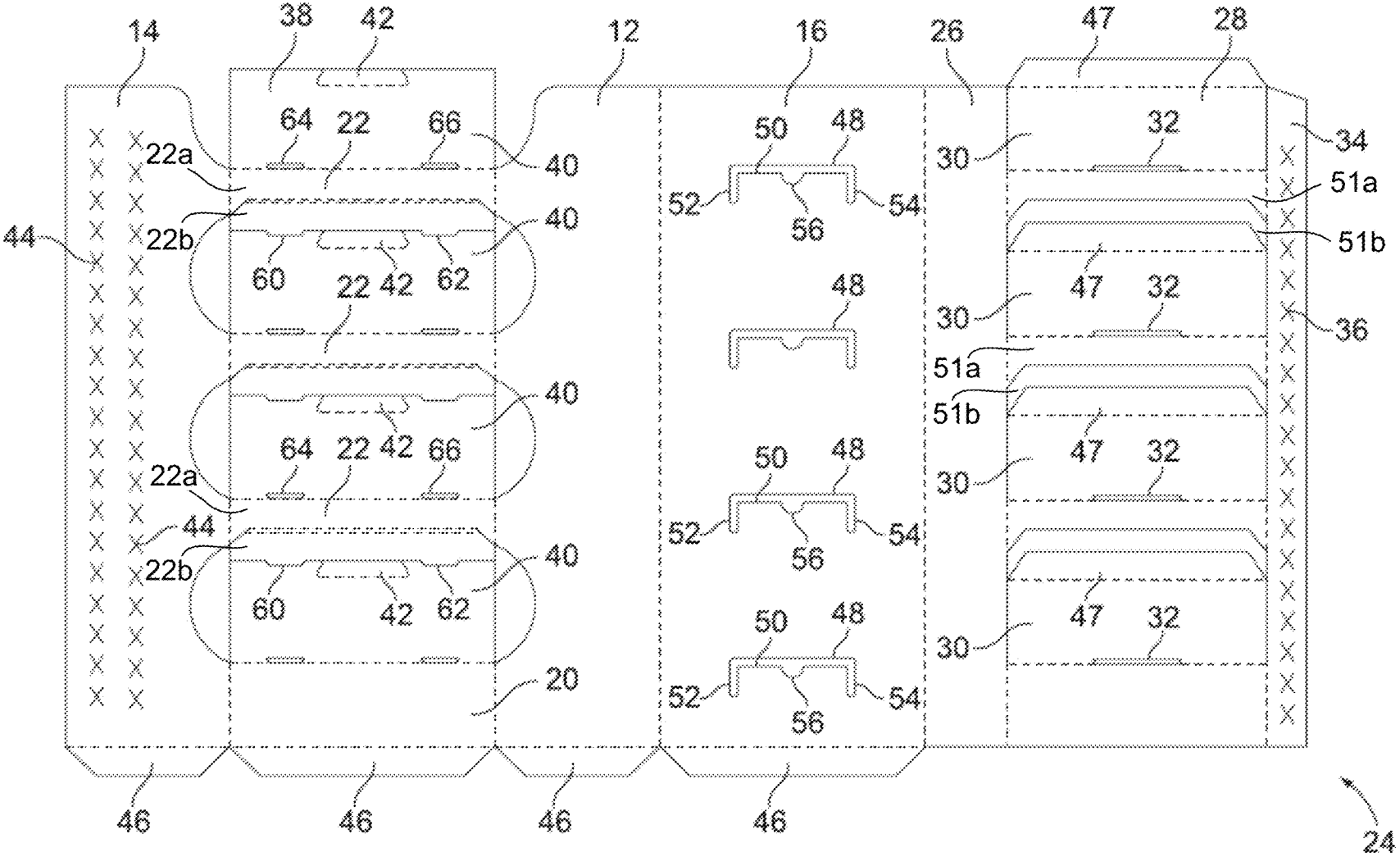
FIG. 1 PRIOR ART
FIG. 1 is a plan view of a prior art blank of corrugated material for constructing a shelving display.
Figure 3:
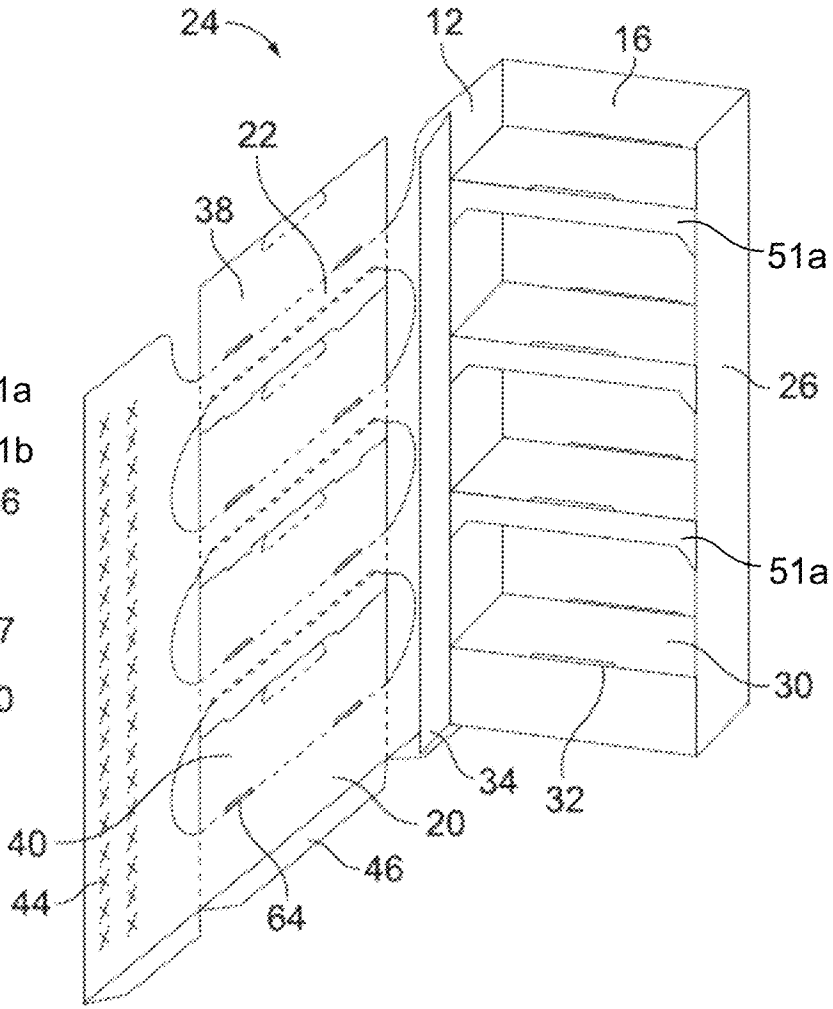
FIG. 3 PRIOR ART
FIG. 3 is a perspective view of the prior art blank of FIG. 1 further folded from the position in FIG. 2.
Figure 2:
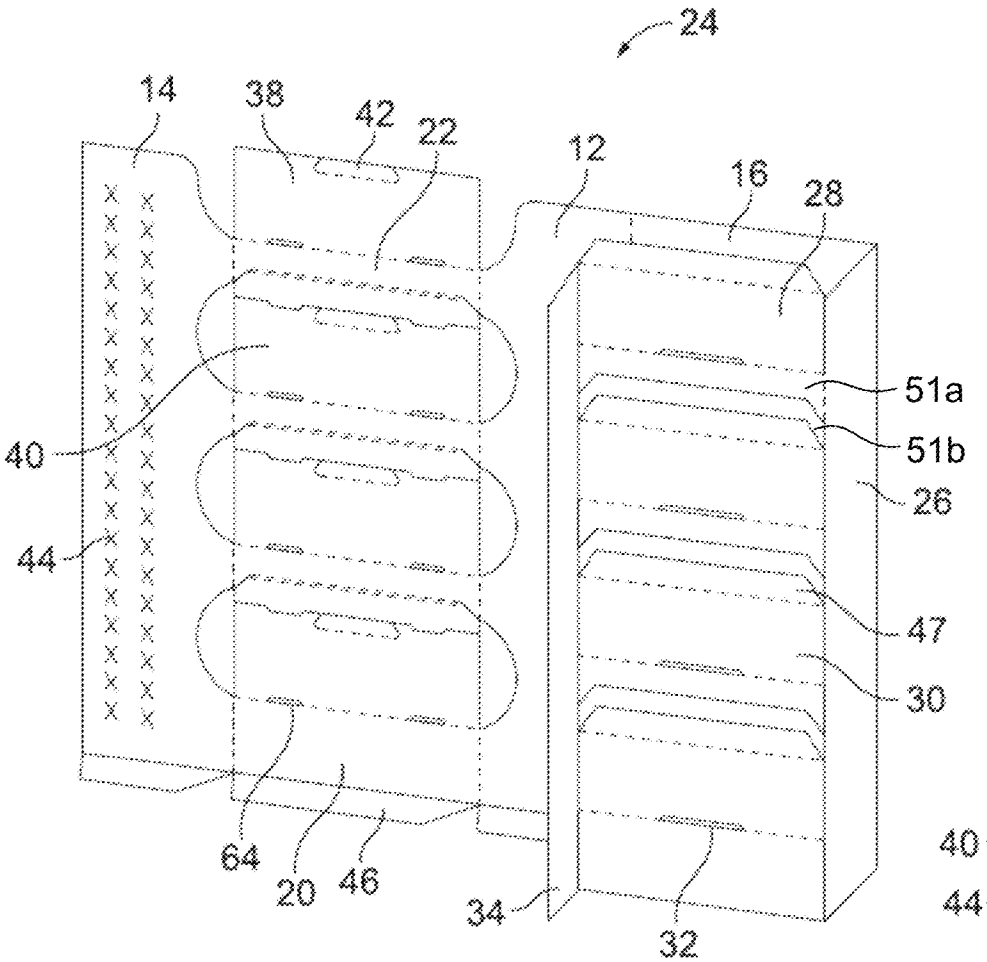
FIG. 2 PRIOR ART
FIG. 2 is a perspective view of the prior art blank of FIG. 1 partially folded into a shelving display.

Referring to FIG. 1, a blank of corrugated material 24 is shown that can be set up into the shelving display 10 shown in FIG. 6. As shown progressively in FIGS. 2-5, the blank 24 is folded into the proper shape and glued into place. Dashed lines on the blank 24 generally indicate fold lines where the blank 24 is folded to create the shelf display shown in FIG. 6. Certain bold lines indicate cut or perforated lines on the blank 24.

The blank 24 includes a back panel which forms the back wall 16. A panel that forms the first side wall 12 is integrally connected on one side to a first side of the panel that forms the back wall 16. The panel that forms the back wall 16 is integrally connected on its other side to a first side of a positioning panel 26.

The positioning panel 26 is integrally connected on a second side to one side of a first shelf panel 28. The first shelf panel 28 includes a plurality of first shelf components 30. Each of the first shelf components 30 includes a slot 32. The first shelf panel includes a segmented front panel 51 having a first portion 51*a* and a second portion 51*b*. The panel 30 is folded 90° downward toward the back wall 16 from the first portion 51*a* and the second portion 51*b* is removed.

A relatively thin strip panel 34 is integrally connected to the other side of the first shelf panel 28. The thin strip panel is provided with glue for securing the panel to another portion of the shelf display 24. A plurality of "X's" 36 are used to generally indicate the preferred areas for applying the glue.

The first side wall 12 is integrally connected on an opposing side (to the side connected to the back wall panel 16) to a first side of a second shelf panel 38. The second shelf panel 38 includes a plurality of second shelf components 40. The plurality of second shelf components 40 correspond to the plurality of first shelf components 30. Each of the plurality of second shelf components 40 includes a tab portion 42. The lower most shelf of the plurality of second shelf components 40 includes the front panel 20 that, in part, forms the base of the shelving display 10.

The second shelf panel 38 is integrally connected on a second side to a panel that forms the second side wall 14. The second side wall 14 also includes glue areas designated by "X's" 44.

The blank 24 also includes bottom flaps 46 extending downward from the first and second side walls 12, 14, the back wall 16 and the second shelf panel 38. The bottom flaps 46 are folded under the shelving display 10 when set up and form part of the base portion.

To set up the shelving display 10 from the blank 24, both the first side wall 12 and the positioning panel 26 are folded forward to be at a right angle with respect to the back wall 16. The first shelf panel 28 is then folded toward the first side wall 12, and the thin strip 34 is glued to an interior surface of the first side wall 12. This supports the first shelf panel 28 parallel to the back wall 16 at a distance equal to the width of the positioning panel 26.

The first shelf components 30 can be folded back toward the back wall 16 to form a back portion for each of the plurality of shelves 18. The first shelf components 30 can be glued to the back wall 16, or include structure, such as a tab 47, that can fit in slots 48 in the back wall 16. The slot 48 includes a horizontal portion 50 and two vertical portions 52, 54 on either side of the horizontal portion 50. A U-shaped opening 56 proximate the middle of the horizontal portion 50 is provided to allow one to pull a portion of the back wall 16 defined by the slots 48 and allow for placement of the tabs 47.

The second shelf panel 38 is folded across the first shelf panel 28, and the second side wall 14 is folded back toward the back wall 16. The glue on the second side wall 14 is used to secure the second side wall 14 to an outer surface of the positioning panel 26.

Once the second shelf panel 38 is positioned, the plurality of second shelf components 40 can be folded back toward the back wall 16 to form a complete shelf with the first shelf components 30 from the first shelf panel 28. The tabs 42 on the second components 40 can be inserted into the slots 32 on the first shelf components 30 to lock the first shelf component 30 to the second shelf component 40. Front panel 22 has a first portion 22*a* and a second portion 22*b* separated by a fold line. The panel 40 is folded 90° downward from the first portion 22*a* and the second portion 22*b* is folded 180° upward to be parallel with and positioned behind the first portion 22*a*. The second portion 22*b* includes a first tab 60 and a second tab 62 which are inserted into corresponding first and second slots 64, 66 on the top edge of the front panel 22 and the second shelf component 40.

Figure 7:
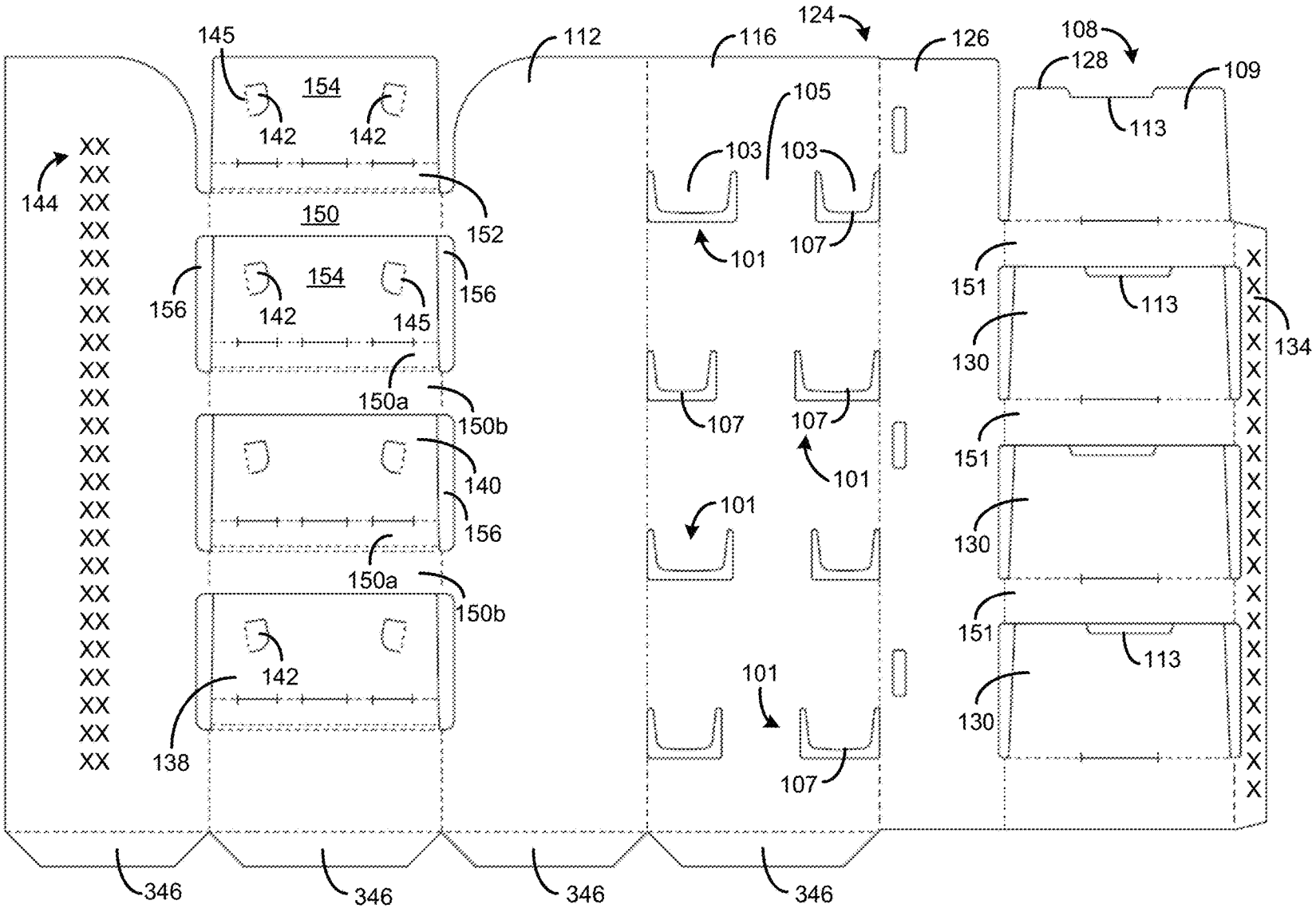
FIG. 7 is a top plan view of a blank of corrugated material for forming a shelving display of the present invention of FIG. 8.
Figure 8:
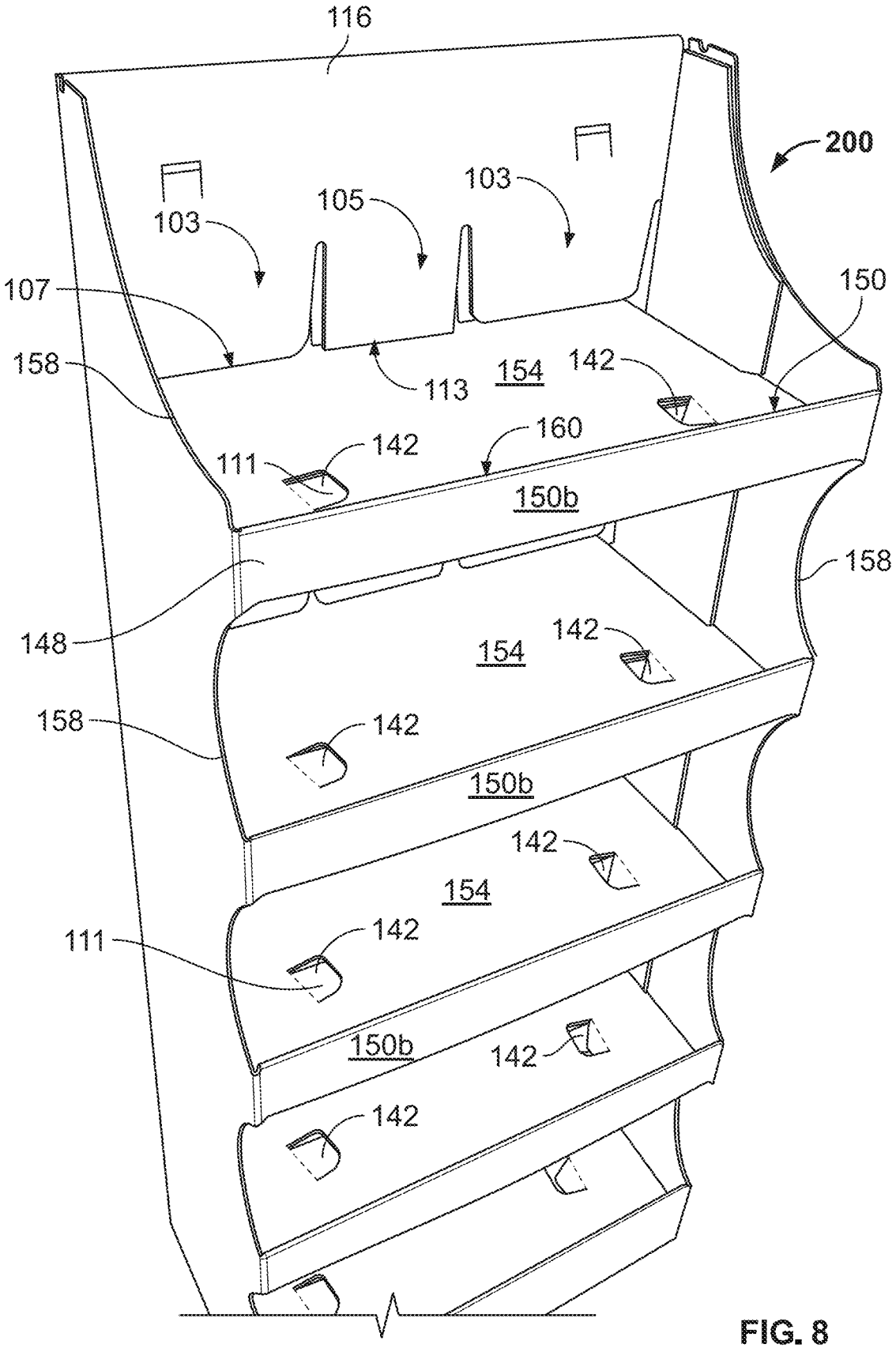
FIG. 8 is a front perspective view of the shelving display of the present invention.
Figure 9:
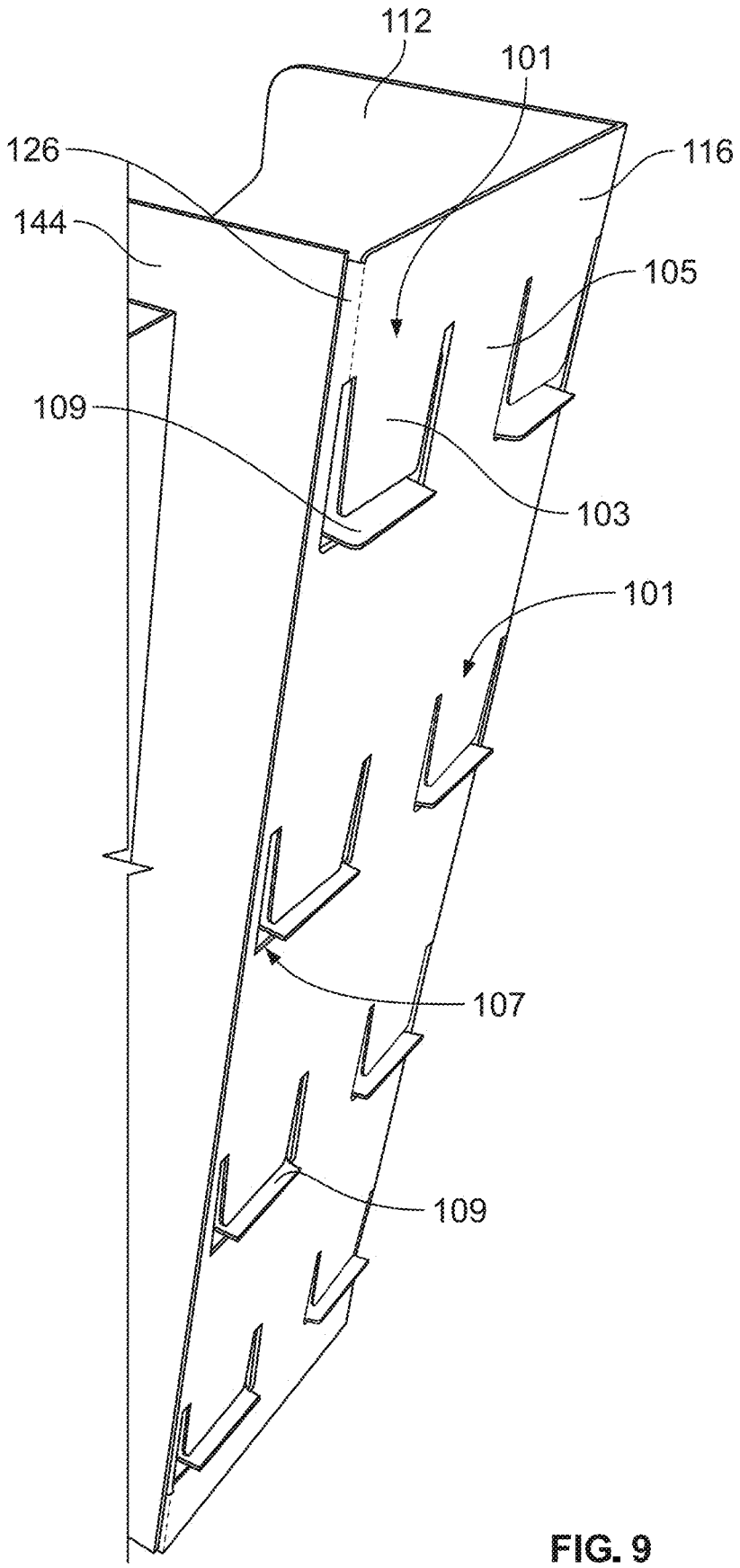
FIG. 9 is a rear-side perspective view of the shelving display of the present invention.
Figure 10:
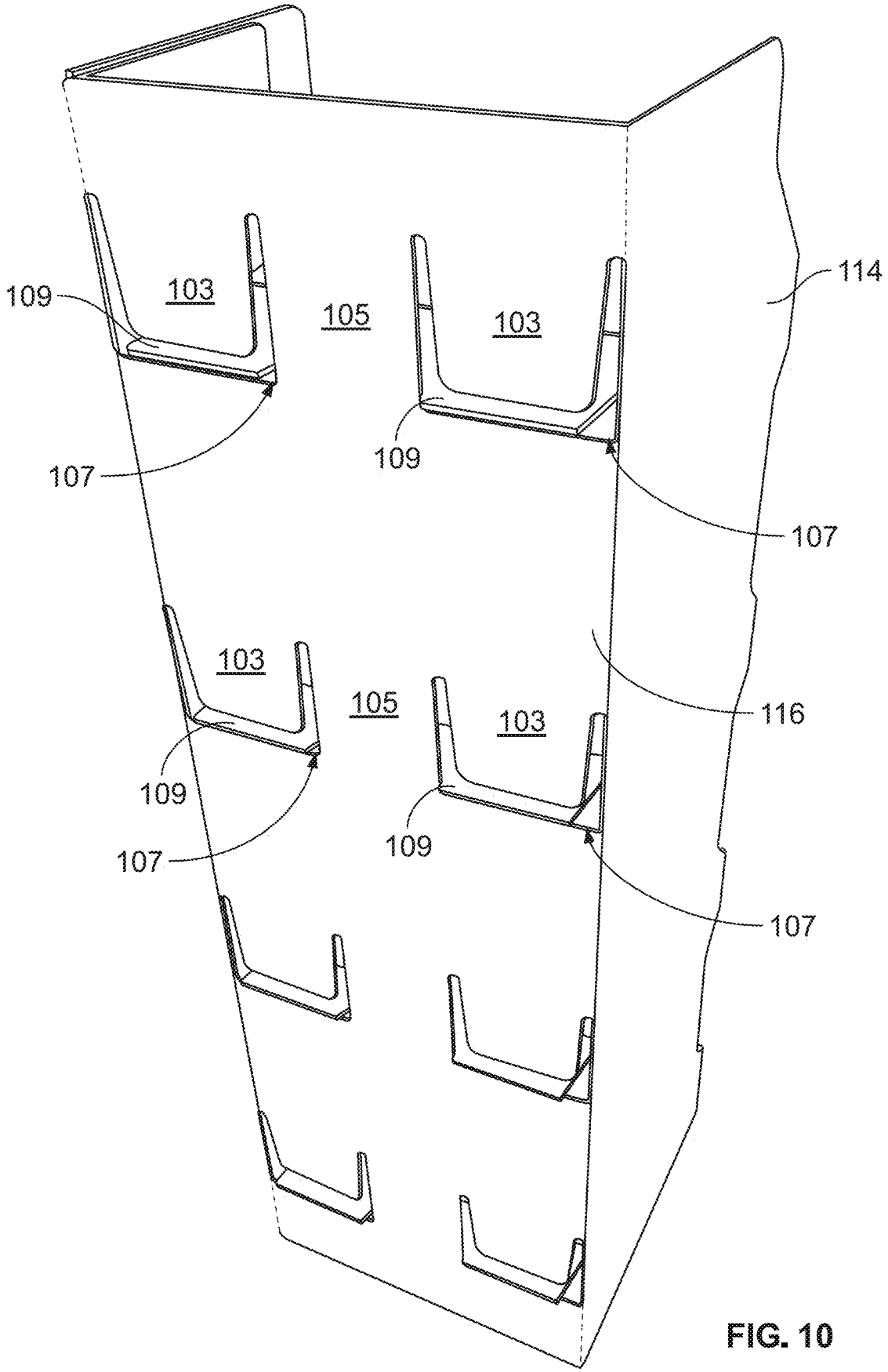
FIG. 10 is a rear perspective view of the shelving display of FIG. 8.

FIG. 7 discloses yet another embodiment of a blank 124 for forming a shelving display 200 of FIGS. 8 and 9. Blank 124 can be folded in similar but improved manner as blank 24 described above with reference to FIGS. 2-5, into the shelving display 200 as shown in FIGS. 8-10. There are differences in how the shelves are folded as will be described below. The blank 124 can be fabricated from paperboard, corrugated paperboard, plastic sheeting, corrugated plastic, and a tri-laminate board.

The blank 124 includes a back panel which forms the back wall 116. A panel that forms the first side wall 112 is integrally connected on one side to a first side of the panel that forms the back wall 116. The panel that forms the back wall 116 is integrally connected on its other side to a first side of a positioning panel 126. A plurality of U-shaped cutouts 101 in the back wall 116 are spaced from one another from a top edge of the blank 124 to a bottom edge of the blank as best seen in FIGS. 9 and 10. In a preferred form, the U-shaped cutouts 101 are in pairs and are spaced apart by a stop panel 105. Each U-shaped cutout 101 has a deflectable tab 103 and a slot 107 that extends through the full thickness of the back wall 116.

The positioning panel 126 is integrally connected on a second side to one side of a first shelf panel 128. The first shelf panel 128 includes a plurality of first shelf components 130. Each of the first shelf components 130 includes a tab receiving portion 111. As explained below, the first shelf components 130 are utilized to form the shelves 118 shown in FIG. 8. Each of the first shelf components 130 also include a leading edge 108, having two spaced-apart flanges 109 flanking a central recess 113. During the shelf-folding process, the two spaced apart flanges 109 are pressed against the deflectable tabs 103 and are guided into the pair of slots 107. A portion of the flange 109 extends through the back wall (FIGS. 9-10) and axially outward beyond an outer surface of the back wall. In this position, a downward facing edge of the deflectable tab 103 contacts an upper surface of the flange 131 to releasably retain the flange 109 in the slot 107 and to support the first shelf component. The central recess 113 abuts or is closely adjacent to the stop panel 105.

A relatively thin strip panel 134 is integrally connected to the other side of the first shelf panel 128. The thin strip panel 134 is provided with glue for securing the panel to another portion of the shelf display 134. A plurality of "X's" 134 are used to generally indicate the preferred areas for applying the glue.

The first side wall 112 is integrally connected on an opposing side (to the side connected to the back wall 116) to a first side of a second shelf panel 138. The second shelf panel 138 includes a plurality of second shelf components 140. The plurality of second shelf components 140 correspond to the plurality of first shelf components 130. Each of the plurality of second shelf components 140 include two frangible tabs 142. The frangible tab 142 is contained fully within the area of the second shelf panel and does not cross any perimeter edges. When the frangible tab 142 is pressed downward, a portion of the tab abuts a portion of a front panel 151 and is connected to the panel by a hinge 145.

Each of the second shelf panels 138 have a vertical front panel 150 and a hinge 152 connected to an object support surface 154. When formed into the shelving display 200, the vertical front panel 150 extends vertically above the shelf support surface 154 and acts as a lip to prevent products from sliding off the shelf support surface 154. The hinge 152 is folded 180° vertically downwardly behind the front panel 150 to form a double thickness vertical wall. Four of the five second shelf components also have two removable chads 156 at opposed lateral edges and are frangibly connected to the blank. Upon assembly of the shelf display 200 the removable chads 156 are torn away to form arcuate shaped 158 edges on a leading edge of the side walls.

The second shelf panel 138 is integrally connected on a second side to a panel that forms the second side wall 114. The second side wall 114 also includes glue areas designated by "X's" 144.

To set up the shelving display 200 from the blank 124, both the first side wall 112 and the positioning panel 126 are folded forward to be at a right angle with respect to the back wall 16. The first shelf panel 128 is then folded toward the first side wall 112, and the thin strip 134 is glued to an interior surface of the first side wall 112. This supports the first shelf panel 128 parallel to the back wall 116 at a distance equal to the width of the positioning panel 126.

The second shelf panel 138 is folded across the first shelf panel 128, and the second side wall 114 is folded back toward the back wall 116. The glue 144 on the second side wall 114 is used to secure the second side wall 114 to an outer surface of the positioning panel 126.

Here the folding sequence of each shelf is completed with two simple steps. First a constructor of the display presses down of the second panel 138 toward the back wall into contact with the first shelf panel 130. This causes the first shelf panel to move downwardly together with the second shelf panel where the flanges 109 contact the deflectable tabs 103. The tabs direct the flanges 109 into slots 107. In the second step, the constructor presses the frangible tabs 142 to force a portion of the tabs into contact with the vertical wall 151. This process is repeated until all of the shelves are formed. During these two steps, the second portion **150*b* of the front panel is folded downward and behind the first portion 150*a* into surface contact, or closely adjacent, an inner surface of the first portion 150*a* to form a double thickness front panel 150. A top of the first portion 150*b* extends above the support surface 154 and acts as a lip 160**.

While the display 100 has four shelves it is contemplated that the display can have from one shelf to 10 shelves, for example. More typically the display will have from two to six shelves.

Figure 11:
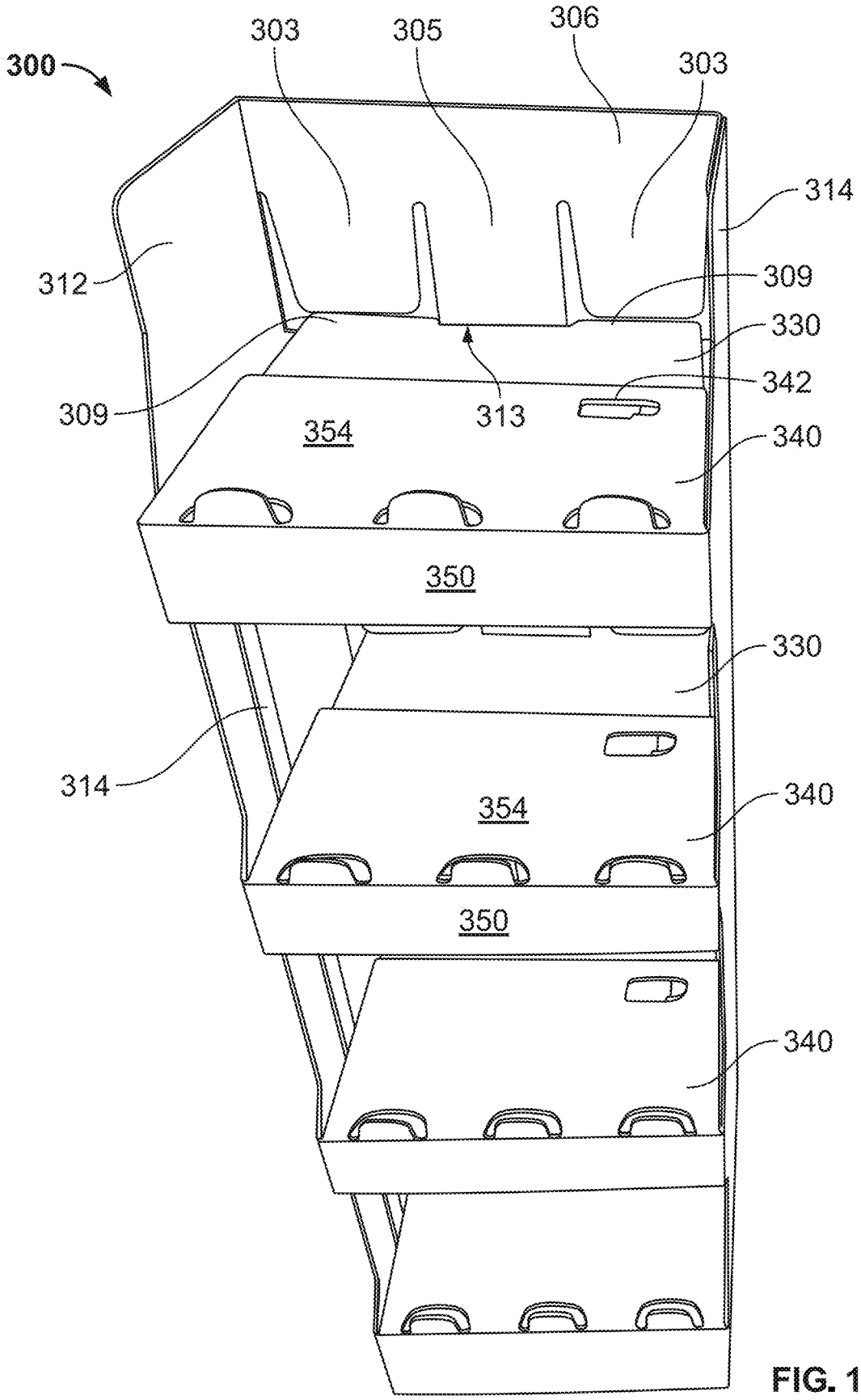
FIG. 11 is a front perspective view of an alternative shelving display also of the present invention.

FIG. 11 shows an alternative embodiment of a shelving display 300 to the shelving display 200 shown in FIG. 8 but differs in a few respects. The shelving display 300 is folded from a blank 324 shown in FIG. 12. Like parts will be referred to with like numbers of FIG. 7, but 300-series numbers are used in place of the 100-series number used in FIGS. 7 and 8. First, in place of the two frangible tabs 142, there is a single frangible tab 342 and a tab receiving portion 311. The frangible tab 342 is dimensioned to fit within and be releasably retained in the receiving portion 111. Also, the hinge 142 is not present so the vertical panel 350 is directly connected to the object support surface 354 so there is no lip 160 spanning the entire width dimension of the front panel 350. The lip 160 is replaced by three upstanding tabs 360 horizontally spaced along a trailing edge of the second shelf component 340. The upstanding tabs 360 correspond with arcuate-shaped cutouts 362 on the second shelf component 31540.

Figure 12:
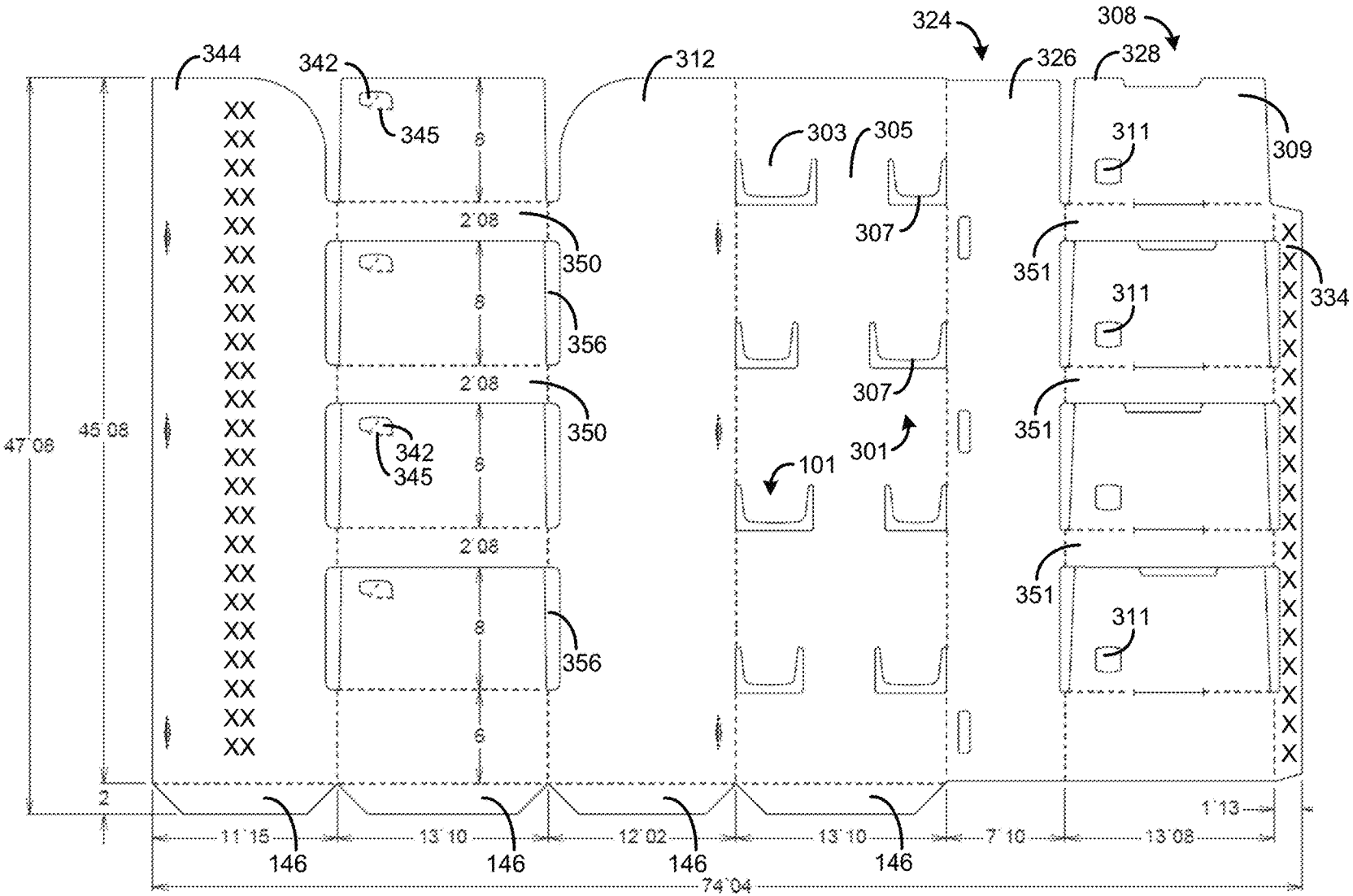
FIG. 12 is a top plan view of a blank of corrugated material for forming the shelving unit of FIG. 11.

FIG. 12 shows the blank 324 for forming the shelving display of FIG. 11. The blank 324 is folded in the same two-step process as the blank 124 is folded to form the display of FIG. 8.

While the specific embodiments have been illustrated and described, numerous modifications come to mind without significantly departing from the spirit of the invention and the scope of protection is only limited by the scope of the accompanying claims.

I claim:

1. A shelving display comprising:

a back panel;

a first side wall extending outward from a first side of the back panel and a second side wall extending outward from a second side of the back panel;

a first shelf panel extending between the first side wall and the second side wall having a plurality of first shelf components bendable backward toward the back panel and extending from a first front panel of the first shelf panel; and, a second shelf panel extending between the first side wall and the second side wall having a plurality of second shelf components bendable backward toward the back panel and extending from a second front panel of the second shelf panel, each of the second shelf components having a first tab bendable downward wherein the first tab is positioned to abut a first portion of a front panel of the first shelf panel, wherein each of the first shelf components includes a first flange extending outward toward the back panel and a second flange spaced from the first flange extending outward toward the back panel and wherein the back panel includes a plurality of U-shaped cutouts for receiving one of the first flange and the second flange.

2. The shelving display of claim 1 further comprising the first side wall connected to the second shelf panel.

3. The shelving display of claim 2 further comprising a positioning panel connected to the second side of the back panel and the first shelf panel wherein the positioning panel has a width less than a width of the first side wall.

4. The shelving display of claim 3 further comprising the second side wall extending from the second shelf panel to the back panel.

5. The shelving display of claim 3 further comprising a glue panel connected to the first shelf panel wherein the glue panel is positioned to contact and adhere to an inside surface of the first side wall.

6. The shelving display of claim 1 wherein each first tab includes a frangible portion and a hinge portion connected to the second shelf component.

7. The shelving display of claim 1 wherein each of the second shelf components includes a second tab spaced from the first tab wherein the second tab is positioned to abut a second portion of the front panel of the first shelf panel.

8. The shelving display of claim 7 wherein each second tab includes a frangible portion and a hinge portion connected to the second shelf component.

9. The shelving display of claim 1 wherein the shelving display is formed from a single blank of corrugated paper.

10. The shelving display of claim 1 wherein the shelving display is formed from a single blank of paperboard.

11. The shelving display of claim 1 wherein the shelving display is formed from a single blank of corrugated plastic.

12. The shelving display of claim 1 wherein the shelving display is formed from a single blank of tri-laminate board.

13. A shelving display comprising:

a back panel;

a first side wall extending outward from a first side of the back panel and a second side wall extending outward from a second side of the back panel;

a first shelf panel extending between the first side wall and the second side wall having a plurality of first shelf components bendable backward toward the back panel and extending from a first front panel of the first shelf panel, each first shelf component having a first tab receiving portion; and, a second shelf panel extending between the first side wall and the second side wall having a plurality of second shelf components bendable backward toward the back panel and extending from a second front panel of the second shelf panel, each of the second shelf components having a first tab positioned to be received in the first tab receiving portion of a first shelf component, wherein each of the first shelf components includes a first flange extending outward toward the back panel and a second flange spaced from the first flange extending outward toward the back panel and wherein the back panel includes a plurality of U-shaped cutouts for receiving one of the first flange and the second flange.

14. The shelving display of claim 13 further comprising the first side wall connected to the second shelf panel.

15. The shelving display of claim 14 further comprising a positioning panel connected to the second side of the back panel and the first shelf panel wherein the positioning panel has a width less than a width of the first side wall.

16. The shelving display of claim 15 further comprising the second side wall extending from the second shelf panel to the back panel.

17. The shelving display of claim 16 wherein the shelving display is formed from a single blank of corrugated paper.

18. The shelving display of claim 13 wherein each first tab includes a frangible portion and a hinge portion connected to the second shelf component.

* * * * *